US007312709B2

(12) United States Patent
Kingston

(10) Patent No.: US 7,312,709 B2
(45) Date of Patent: Dec. 25, 2007

(54) ALARM SIGNALLING DEVICE AND ALARM SYSTEM

(76) Inventor: John Edward Kingston, 49 Allestree Drive, Scartho, Grimsby, Lincs (GB) DN33 3DX ( * ) Notice: Subject to any disclaimer, the term of this patent is extended or adjusted under 35 U.S.C. 154(b) by 179 days.

(21) Appl. No.: 10/523,115

(22) PCT Filed: Aug. 1, 2003

(86) PCT No.: PCT/GB03/03333

§ 371 (c)(1),
(2), (4) Date: Feb. 2, 2005

(87) PCT Pub. No.: WO2004/013824

PCT Pub. Date: Feb. 12, 2004

(65) Prior Publication Data

US 2005/0231375 A1 Oct. 20, 2005

(30) Foreign Application Priority Data

Aug. 3, 2002 (GB) ..... 0218076.8

(51) Int. Cl.
*G08B 23/00* (2006.01)

(52) U.S. Cl. ..... 340/573.1; 340/539.1; 340/539.11; 340/539.13; 340/539.12

(58) Field of Classification Search ..... 340/573.1, 340/539.1, 539.11, 539.13, 539.12
See application file for complete search history.

(56) References Cited

U.S. PATENT DOCUMENTS

| | | | | |
|---|---|---|---|---|
| 5,732,125 | A | 3/1998 | Oyama | |
| 6,362,778 | B2 | 3/2002 | Neher | |
| 6,388,612 | B1 | 5/2002 | Neher | |
| 6,398,727 | B1 | 6/2002 | Bui et al. | |
| 6,614,883 | B2 | 9/2003 | Baum et al. | |
| 6,940,403 | B2 * | 9/2005 | Kail, IV | 340/539.12 |
| 7,038,590 | B2 * | 5/2006 | Hoffman et al. | 340/573.1 |
| 2001/0020898 | A1 | 9/2001 | Pierce et al. | |
| 2001/0026240 | A1 | 10/2001 | Neher | |

FOREIGN PATENT DOCUMENTS

| | | |
|---|---|---|
| DE | 200 20 942 | 5/2002 |
| EP | 1 216 890 | 6/2002 |
| WO | WO 01/73466 | 10/2001 |

* cited by examiner

*Primary Examiner*—Daryl C Pope
(74) *Attorney, Agent, or Firm*—Richard M. Goldberg

(57) ABSTRACT

An alarm system includes an alarm signalling device having a transceiver for transmitting an alarm signal. The system includes a responder device for receiving the alarm signal, the responder device having a device for signalling an alarm. The alarm signalling device includes an interface for receiving user information and an activating device for activating the transceiver to transmit the alarm signal in response to the user information. The transceiver device further includes a device for receiving a response signal from the responder device.

24 Claims, 1 Drawing Sheet

ALARM SIGNALLING DEVICE AND ALARM SYSTEM

BACKGROUND OF INVENTION

The present invention relates to an alarm system, an alarm signalling device and a method of transmitting and receiving alarm signals from a user, particularly but not exclusively to an alarm system adapted to receive distress signals from a user.

Portable telephones or mobile telephones are suitable for contacting emergency services in the event of an accident or emergency. These telephones are however not suitable for use as a personal emergency device by elderly people and disabled people for everyday use. Today's modern mobile telephones are still too bulky, heavy and therefore clumsy to be carried around all day by a user, particularly in and around the house. Also, as the telephone must be readily usable in the case of an emergency, the device must be switched on continuously. This is not feasible as mobile telephone batteries require frequent recharging. Furthermore, a mobile phone is expensive to operate due to the high call charges and the transmission of the mobile phone signal is not always reliable. Mobile telephones are therefore unsuitable to be used by elderly people and disabled people as a personal alarm device for contacting emergency services.

Document WO 91/15989 discloses an alarm system comprising a base station and an alarm device which is worn on a person. The alarm device comprises an emergency button for triggering an internal transmitter which transmits an alarm signal. The transmitted signal is received by the base station which triggers an audible and visual warning signal.

This device has the disadvantage that the user is unaware of the activation of the warning signal after the internal transmitter is triggered, unless the user is in the direct vicinity of the base station. If no help arrives immediately or if the user is not sure if the base station has received the alarm signal, this increases the anxiety of the user.

Also, certain users such as disabled users may not be physically capable of activating the alarm signalling device or they may not be physically capable of perceiving the triggered warning signal. In those cases, the user can also get distressed.

It is therefore desirable to provide an improved alarm system, an improved alarm signalling device and a method of receiving alarm signals from a user, thereby addressing the above described problems, and/or which offers improvements generally.

SUMMARY OF THE INVENTION

In embodiments of the present invention, there are provided an improved alarm system, an improved alarm signalling device and a method of receiving alarm signals from a user as defined in any of the accompanying claims.

In an embodiment of the invention, there is provided an alarm signalling device adapted to be worn on the user's body comprising a user activatable transceiver means for transmitting an alarm signal to a responder device, the transceiver means being adapted to receive a response signal from the responder device in response to the alarm signal, and the alarm signalling device further comprising a user display means to display the response signal to the user, the responder device being adapted to contact and/or connect to outside help.

As the display means immediately inform the user that the alarm signal has been received by the responder device and that help is forthcoming, the user's anxiety and distress are greatly reduced.

The outside help may comprise an emergency service such as a doctor, hospital or ambulance, and/or a caretaker such as a nurse, and/or a person such as a neighbour or relative, and/or a monitoring station, such as a centre for receiving signals or calls from the responder device.

The responder device is preferably provided locally, in the vicinity of the user, such as in the user's house. As the distance between the responder device and the alarm signalling device is relatively small in comparison to a conventional mobile telephone and the receiver of a mobile telephone network, the power required for the alarm signalling device to contact the responder device is greatly reduced in comparison to a conventional mobile telephone. This allows the alarm signalling device to be switched on continuously for very long periods of typically months or years.

Alternatively, the responder device may be formed by a telephone network and more in particular by a mobile telephone network. For example, if the user is not too far removed from a telephone network receiver, the alarm signalling device may be adapted to directly contact outside help.

In a preferred embodiment, alarm signalling device may comprise one or more activators for activating the transceiver means. The activators may be operated by the user. Preferably, the activator comprises a panic button. The panic button may be pressed to activate the transceiver which transmits the emergency signal to the responder device. Upon receipt of the alarm signal, the responder device transmits a response signal to the transceiver. This signal is displayed to the user.

The panic button may be slightly recessed. The panic button may also have a protective rim to prevent accidental activation. The panic button may also be covered by a protective cover which covers the front of the alarm signalling device to prevent accidental activation.

In another embodiment, the activator may comprise a medical sensor or body sensor for sensing medical or body related data such as pulse or temperature, the activator being adapted to activate the transceiver means in response to abnormal medical or body data such as a low pulse or a low heart rate.

In an embodiment, the alarm signalling device may be small and/or lightweight and/or portable so as to prevent obstructing the user's freedom of movement. The alarm signalling device may for example be in the form of a wrist band (similar to a watch) or a pendant. The alarm signalling device may comprise a housing which may be designed and manufactured so that it may comprise various connections and/or add ons so that it may be carried as a pager or can be worn as a pendant, on a belt key fob or attached to the user's clothing by safety pin(s), spring clip or other securing means. The alarm signalling device may also comprise a watch or a clock. The watch or clock may comprise functions which are commonly found in watches or clocks such as a time alarm.

In this way, the user wears or has within his/her direct possession a personal alarm signalling device. The alarm signalling device may be totally waterproof and intrinsically safe.

The transceiver means may comprise an alarm signal transceiver, which communicates with a responder device such as a telephone console or base station which houses a responder transceiver. The transceiver means may comprise AM (amplitude modulation), FM (Frequency Modulation) (in all its forms), Phase Modulation (in all its forms), broad spectrum or 'Bluetooth' technology, or other forms of wireless transmission technology. The transceiver means may comprise single channel or multi-channel transceiver devices. The transceiver means may also comprise digital transceiver means.

In an embodiment, the transceiver device may comprise display means for representing the response signal from the responder device. The display means may comprise a visual display means and/or an audible display means signal and/or a tactile display means.

The display means may inform the user that the alarm signalling device has been activated in various ways. The display means may comprise one or more user attention means comprising: (a) tactile display means such as a vibrating device, (b) LED, LCD (Liquid Crystal display), plasma or similar display means which enables data/pictures/video or text to be made visual to benefit the hard of hearing or the deaf, (c) audible display means such as an audible signal which sounds for a set time, (d) a pre-recorded voice message which informs the user that the user has activated the signalling device, and (e) LED(s) (light emitting diodes) mounted within the alarm signalling device(s) housing or panic button(s). Once the user activates the alarm signalling device, the display means are activated.

For example, when the alarm signalling device is activated the LED(s) and/or panic button(s) may colour red. The buttons may also comprise a fixed or flashing LED to inform the user that the signal is being transmitted to the responder device and they may change to a fixed red (not flashing) or different colour LED(s) once a connection has been made either to the responder device or monitoring station or end user.

The alarm signalling device may comprise interface means for receiving user data and responder data. The user data may comprise the user's voice and/or data relating to the user's physical condition.

The transceiver means may be adapted to transmit the user data to the responder device after receipt of the response signal, and the transceiver means may be adapted to receive the responder data from the responder device. The interface means may comprise a sound receiving member in the form of a microphone and/or a sound producing member in the form of a speaker. This provides a true two way conversation between the user and a monitoring station such as the emergency services, doctor, home-help or designated end users. This also gives the user piece of mind as the user is informed that help is provided. The responder data may also be displayed by the display means to benefit deaf users.

The volume of the speaker housed within the alarm signalling device could be fixed or adjusted manually/automatically by slider control sensor(s) and/or button(s) and/or by using voice commands (voice activated) and/or by using any of the button(s) which are used to initiate an alarm call once the alarm has been activated. The volume may also be controlled manually or automatically by the monitoring station or emergency services. The display means may display the volume level.

The user's speech may be digitised and then converted from a digital speech signal to an analogue speech signal either by the responder device or by the signalling device. The responder device may communicate with a monitoring station, emergency service or end user down a hard wired or wireless telephone line or via other transmission methods such as a modem.

The alarm signalling device may remotely operate other appliances and/or peripherals such as doorbells, telephones, smoke detectors, alarm systems and other domestic systems that can alert a deaf person, so long as those devices have a transmitter/transceiver operating on the same frequency and own identity code, to identify that unit. Data from the appliances and/or peripherals may be provided to the user as responder data via the interface means.

In another embodiment, the responder device comprises one or more microphones and one or more speakers. This obviates the need for a microphone and a speaker in the alarm signalling device. This greatly reduces the overall cost of the alarm system. The microphone and/or speakers may located at various locations for example around the user's house and they may be connected to the responder device to allow two-way conversation to take place between the user and the outside help in any location. The microphones may be housed in the speakers.

The display means may be integrated within the alarm signalling device and/or responder device and operated for a fixed or varied time to alert the user that they have activated the alarm signalling device, and/or to alert the user where they are 'sequence wise', during the transmission/connection period, following through to the disconnection period. This gives the user piece of mind that they can actually see and hear the aid services being provided.

The responder may also be adapted to dial aid services and the user may communicate with the aid services via the interface means.

In a further embodiment of the invention there is provided an alarm signalling device comprising means for informing the user of the activation of the alarm signal and/or subsequent actions by a responder device.

In another embodiment of the invention there is provided an alarm system comprising a responder device for receiving an alarm signal from an alarm signalling device, the responder device comprising means for signalling an alarm, the alarm signalling device comprising interface means for receiving user information and activator means for activating transmission of the alarm signal in response to the user information.

The alarm system may comprise control means for controlling the activation means in response to user health data. The system may comprise storage means for storing user health records, the control means controlling the activating means if the health data are not in keep with the user health records. For example, if the user's health data deviate from the data stored in the health records as a result of an abnormality in the physical condition of the user, then the alarm signalling device is activated.

In a further embodiment of the invention, the alarm system comprises identification means for identifying an alarm signalling device. The system comprises one or more responder devices and one or more alarm signalling devices, the responder device signalling an alarm signal which corresponds to the identified alarm signalling device. In this way the system is adapted to monitor multiple alarm signalling devices.

The system may comprise procedure storage means for storing alarm procedures for each alarm signalling device, the alarm signalling means signalling an alarm in accordance with the stored alarm procedure for the identified alarm signalling device. This allows the system to conduct specified alarm procedures for each individual activated alarm signalling device.

The alarm procedures may comprise the steps of dialling a specific emergency service number, dialling a relative, providing audio or visual alarm signals, etc. The alarm signalling means may be configured to signal the alarm by following the alarm signalling procedure for a particular alarm signalling device. The procedure may define the types of alarm to be signalled and/or the sequence of the alarms and/or including telephone numbers to be dialled. For example, if a particular alarm signalling device is activated, according the alarm procedure which corresponds to a particular alarm signalling device, the external audible alarm may be activated, an emergency number may be dialled and if there is no response a subsequent number may be dialled. In this way, for each individual alarm signalling device user the appropriate alarm procedure is conducted. The alarm procedures may be entered into the system by means of a suitable responder interface such as a link via a computer.

In another embodiment of the invention, the alarm system may comprise signal channel selection means for selecting the transmission frequency or transmission channel for transmitting the alarm signal. This arrangement allows the system to change its transmission frequency if the transmission quality for a particular frequency is poor for example due to interference.

In a preferred embodiment of the invention, the transceiver means may comprise signal channel selection means for selecting the transmission frequency or transmission channel for transmitting the alarm signal. The transceiver means may be adapted to receive a channel control signal from the responder for controlling the signal channel selection means. This arrangement allows the transceiver to change its transmission frequency if the transmission quality for a particular frequency is poor for example due to interference. Another important advantage of this arrangement is that multiple alarm signalling devices may be used with a single responder device. The channel selection means then automatically provides a suitable transmission channel for each alarm signalling device which does not interfere with the transmissions of the other alarm signalling devices. This obviates the need for changing transmission settings on the alarm signalling device and/or responder device if additional alarm signalling devices and/or responder devices are provided.

In an embodiment of the invention, the alarm system may comprise interface means for receiving user data, the transceiver means being adapted to transmit the user data to the responder device after receipt of the response signal. The interface means may also comprise means for receiving responder data, the transceiver means being adapted to transmit the responder data to the responder device. Preferably, the responder comprises interface means for receiving user data. The responder device may transmit the user data to a monitoring station so that the data are stored, monitored or processed otherwise.

The interface means may comprise a button or switch for receiving the user's distress or alarm notification. The interface means may also comprise voice receiving means for receiving the user's voice instructions. The interface means may also be adapted to interface with one or more sensors for sensing the physical condition of the user. These sensing devices may comprise blood pressure sensors, temperature sensors, heart rate sensors or any other suitable monitoring devices for sensing medical conditions.

In a preferred embodiment, the responder device may be connectable to a telephone line. The responder device may be adapted to dial one or more emergency numbers. The responder device may further comprise dialling means for dialling one or more emergency numbers. The dialling means may dial a first telephone number and if no connection is made to the first number, the dialling means dial a further number. The dialling means may also be adapted to dial a further number if the responder device connects to an answering machine or a fax machine. The dialling means may comprise a telephone number storage means. The responder device may also comprise alternative alarm signals such as audio/visual alarm signals. In this way the appropriate emergency services or relatives may be contacted or alternative appropriate actions may be taken such as the sounding of an alarm.

In another embodiment of the invention, the alarm system may comprise a distance monitoring means or range monitoring means for monitoring the distance between the responder device and the alarm signalling device. If the distance monitoring means detects that the alarm signalling device is approaching the maximum allowable distance, the user may be informed of this.

The responder device preferably comprises a range monitoring means. The alarm signalling device may also comprise range monitoring means for monitoring the distance between the responder device and the alarm signalling device. The range monitoring means may also monitor the signal strength of the transmitted signal of the alarm signalling device at the responder device or vice versa. If the signal is too weak, the range monitoring means may inform the user that the alarm signalling device is out of range.

In another embodiment, the range monitoring means may contact the outside help to inform the outside help that the distance between the responder device and the alarm signalling device is too large. This allows staff to assist the user. This feature is useful in psychiatric hospitals, prisons and probation centres.

The alarm signalling devices or transceivers as hereinbefore described may also have the facility of a 'range finder' facility, such that by pressing a button(s) on the alarm signalling device the display means inform the user that they have pressed the 'range finder' button, and that the transceiver has sent a coded signal to the responder device. On receipt of that coded signal, a coded signal is sent back to the user's alarm signalling device, which then activates the display means for example by illuminating another LED and/or the original LED changes to another colour for a period of time set by the manufacturer.

The range finder gives the user peace of mind that at any time the user can check whether he/she is in range of the responder device if he/she needed to press the panic button(s). The display means may also give information/data, such as a battery level indicator, and data regarding the range, which may then be downloaded with other relevant information from the responder device as and when, via the user or, on command from the monitoring station/end-user at preset or variable times, or when the panic button is activated. If the user was out of range then the alarm signalling device would not receive a coded signal back. If the responder device did not receive the coded signal from the alarm signalling device or if the telephone console responder device has received the coded signal from activating the range finder on the alarm signalling device this may be indicated on the responder device which may then give a visual or audible indication. Either way the user is aware whether he/she is in range or not and the user may perform a check on the system.

In another embodiment, the alarm system may comprise means for verifying operation of the system. The operation verification means may comprise self-diagnostic checks. These checks may comprise a test sequence whereby the alarm signalling device is activated, and the responder device provides a response signal and a diagnostic alarm signal is provided to a responder monitoring station.

The test sequence may be conducted at preset times or the test sequence may be activated by the monitoring station or end user. The test sequence may also provide information on the battery status. The verification means informs the responder device and/or monitoring station when the battery status reaches a level where it requires recharging or a replacement battery, either when the batteries are low or just before the batteries are too low. The verification means may also activate the display means of the alarm signalling device to notify the user of the battery status.

The system may further comprise a power management system for managing the power output of the signalling transceiver and/or responder device depending on the distance between the device and the responder device so as to ensure optimum transmission of signals at a lowest possible power level.

The system may further comprise locating means for storing the position of the transceiver device in the responder so that the alarm signalling device can be conveniently located. The alarm signalling device may have the option to incorporate GPS (global positioning system) or similar global wireless positioning equipment/software, which on activation of the alarm trigger and relevant GPS/wireless positioning equipment and associated software, allow a monitoring station to be able to locate the user anywhere in the world which is most advantageous with all the alarm signalling devices but more advantageous with the system. The system may also act as a means of keeping an eye on criminals/patients, and those who are on probation.

In a further embodiment of the invention, the alarm signalling device comprises means for informing the user of the activation of the alarm signal and/or subsequent actions by a responder device. The alarm signalling device may comprise a transceiver for transmitting an alarm signal, interface means for receiving user data and activator means for activating the transceiver to transmit the alarm signal in response to the user information, wherein the transceiver device further comprises means for receiving a response signal from a responder device, and the alarm signalling device comprises user display means for representing the response signal to the user.

In a further embodiment, the alarm signalling device may be adapted to receive incoming calls. This allows the user to answer telephone calls from a remote location. The user may speak to callers via the alarm signalling device and the caller may be heard from a loudspeaker which may be provided on the responder device.

In a further embodiment, the alarm signalling device may bypass the responder device/telephone console and connect directly to the telephone network by using bluetooth technology and/or by using mobile wireless telephony technology/satellite communications either to a landline/cable or mobile telephone network and operate throughout the designated countries similar to a mobile telephone, linking the user to a monitoring station or predetermined telephone number set. A number of preset numbers may be programmed into the alarm trigger by either the user or monitoring station/operator/manufacturer, and they may be programmed via speech recognition, by keypad on the alarm trigger, or externally via a telephone console or some other external means. Either/or all of the above activation actions may be integrated within the system for a fixed or varied time to alert the user that they have activated the alarm signalling device, and/or to alert the user where they are 'sequence wise', during this transmission/connection period, following through to the disconnection period. This gives the user piece of mind that they can actually see and hear the events unfold.

In an embodiment of the invention, the transceivers in both the alarm signalling device(s) and responder device may be programmed to operate at a fixed power output but not exceeding that stated by the DTI Radio Communications Agency and other relevant bodies/regulations. However the transceivers may comprise a power management system so that the transceivers are adapted to continually monitor both the power output and the power received so as to then alter the power output such that it operates efficiently to conserve battery power. The monitoring station/end-user may also (if required) have the ability to increase or decrease the power output if required. The power output level may be indicated on the alarm trigger via LED(s), or via information such as a graph or other means of measurement which may then be displayed on the screen.

The alarm signalling device(s) may be powered from internal/external rechargeable batteries which may be recharged by conventional means or by placing the signalling device into an independent charging unit or into a recharging unit which is part of the responder device via suitable electrical contacts provided on the signalling device and the charger located on or within the responder device or independent charging unit. The alarm signalling device may also be powered by non-rechargeable battery(s) if required.

The antenna for the alarm signalling device(s) may be designed such that it is housed internally and imprinted onto a PCB (printed circuit Board) which also comprises the circuitry for the functions of the alarm signalling device. Alternatively, the antenna may be connected to the transceiver via a wire, cable or other connection means which are located inside the housing of the alarm signalling device. The antenna may also be provided on the housing or strap of the alarm signalling device.

As the system has the facility to transmit data, the system may interface with medical monitoring equipment or sensors which can be built into the alarm activating device so as to transmit various medical/environmental data such as blood pressure, heart rate, temperature etc. to the monitoring station, such as a medical centre or end-user, via the responder device. The alarm signalling devices may be designed so as to remain permanently on, or to operate in sleep mode or to be only activated when the panic button(s) is activated.

The system is designed such that it may connect to or communicate with both domestic and commercial security alarm systems, and associated peripherals such as passive infra-red devices, pull cords, smoke detectors, doors, cameras etc., medical monitoring equipment and other ancillary equipment such that relevant data from these systems/accessories can also be sent either manually or automatically via the responder device to a dedicated number or monitoring station programmed by either the user installer/manufacturer or end user. The system may comprise a dedicated telephone connection with a monitoring station to allow the person wearing the alarm signalling device to be heard, yet whilst at the same time having the facility if required, to allow the monitoring station to carry on monitoring and controlling the data from the security alarm system and/or medical monitoring or other ancillary equipment.

The responder device or base station may also house a standby battery in case of mains failure, and may be programmed such that if there was a mains failure then the responder device may dial the monitoring station or another preset number informing them so.

In yet another embodiment of the invention, the responder device may have numerous functions and the station may comprise the following features such as a) the responder device may be a stand alone device that can interface with a user's existing telephone and connect to an existing telephone line;
b) the responder device may be an integral telephone console which carries out the normal functions of a normal telephone unit;
c) a number of alarm signalling devices may be used within the system;
d) the system may enable high quality two way speech;
e) two or more data i/p ports may be programmed to dial separate telephone numbers (for example if the first port was interfaced with an alarm system, and the second port was interfaced with an appliance or any other piece of equipment from which, at preset or varied times and with the user's permission, companies may download data and other information);
f) the responder device may comprise several fast dial memory keys;
g) the keys or buttons may be large to make location of the keys and dialling easy;
h) an LCD/plasma or similar screen which presents various information/data as well as video and text. (This is particularly advantageous to users who are hard of hearing or deaf, and is also an audible and visual confirmation of an alarm call);

the responder device may further comprise a:

i) cancel button;
j) re-dial feature;
k) hands free facility;
l) inductive coupler in handset for use with hearing aids;
m) number of emergency numbers that can be programmed into the system which depend ultimately on the manufacturer;
n) tone dialling for faster dialling;
o) adjustable pre-alarm delay;
p) monitoring of personal alarm battery status;
q) automatic alert of power failure at monitoring station;
r) recall button for use with PABX and BT star services;
s) video camera;
t) e-mail facilities;
u) programming, arming, resetting and test facility, and any other features which the manufacturer deems appropriate in this specialist field.

The responder device may furthermore be portable. This allows the staff that monitor the responder device to carry the device with them during their duties.

In an embodiment of the invention there is provided an alarm system generally, and in particular a personal alarm system for indicating when a user requires assistance, as well as providing the facility for monitoring and sending other medical or security or other relevant data to a responder device or aid services.

The alarm signalling device may be configured at the point of manufacture, or have the facility via switches or other means located internally or externally to be, 'permanently on', or in a 'sleep mode' or remain in the off position, or a combination of all three, until either the panic button(s) or 'range finder' as described below are pressed. For example in the on and/or sleep mode, the alarm signalling device may check with the responder device for any incoming messages (at fixed or varied times) or for incoming callers and/or for instructions from the monitoring station, or to allow the monitoring station to communicate with the alarm signalling device.

The alarm system preferably operates within a frequency band that is licence exempt, within those licence exempt guidelines laid down by individual countries. When activated (by means of pressing one or multiple button(s)/sensor(s) or other switching devices, on the alarm signalling device or by voice activation), the alarm signal device sends a coded/encoded/identification signal to the responder device, which then starts to dial the programmable telephones numbers to a monitoring station or end user, (whilst at all times communicating with the alarm signalling device such that the user is aware of the sequence of events).

Signals from the alarm signalling device are accompanied by an identification code. Once the responder device has received the correct identification code from the alarm signalling device, the responder device automatically dials the preset/programmable telephone numbers in sequence as entered by either the user or on behalf of the user, and then sends a signal back to the alarm signalling device, either before the system started dialling the telephone numbers or after, which in turn via any of the above described activation options informs the user so that the user has piece of mind that the responder device will be ringing the appropriate telephone number(s) such as a monitoring station/emergency services, doctor or friend etc. For example the housing, LED(s) and/or panic button(s) may go a fixed colour, for example orange or a flashing LED to indicate this.

Once the telephone connection has been made, the alarm signalling device in turn, via any of the above activation options, informs the user that the user can now speak into the microphone housed within the alarm signalling device, or the microphone connected directly to the responder device. For example the housing and/or panic button(s) or LED(s) may go a fixed colour for example green or a flashing LED to indicate this. Either or all of the above activation actions can be integrated within the system to alert the user that they have activated the alarm signalling device, for a fixed or varied time and/or to alert the user where they are 'sequence wise', during this transmission/connection period, following through to the telephone connection being disconnected.

To ensure efficient identification of the alarm signalling device, the encoded or identification signal is repeated several times. The encoded or identification signal may be programmed into the system at the point of manufacture or programmed by the user which can be either a fixed code or a rolling code or other coding system as designated by the manufacturer. The code may also be set internally on the alarm signalling device via miniature switches or links which are provided on the printed circuit board, or via a miniature keypad. The user may also programme the code by using the responder device by means explained above which may then be transmitted to the alarm signalling device. All data transmitted between both the alarm signalling devices and the responder device to the end user monitoring station may be encrypted with an encryption programme (s) depending on the user's requirements if total secure data encrypted protection is required.

The responder device or telephone console or base station may house a transceiver which will be able to communicate back and forth with the user's alarm signalling device which also houses a transceiver as described hereinbefore and can be designed for use either with the responder device or without an integrated responder device to provide an easy to use low cost home alarm unit.

The following features may also be incorporated in the alarm system and/or alarm signalling device to provide a social alarm system using cellular or similar wireless technology.

Numerous telephone numbers may be programmed into the alarm signalling device which on activation of the panic button automatically start to dial the telephone numbers as programmed, such that if there is a busy or engaged tone or no answer, the following number is dialled until a telephone connection is made.

The alarm system may be programmed by a home user or a third party (such as a monitoring station or other establishment). Programming of the device may be protected by dedicated security codes to prevent children and other unauthorised users from programming the unit.

The user may use voice recognition, appropriate buttons or switches to scroll through the list of telephone numbers programmed in the alarm signalling device as they are displayed on the alarm device display. Once the appropriate telephone number is highlighted, the user then presses the transmit button to make a telephone call.

The alarm signalling device may also comprise a caller name display and any other telephone functions.

The alarm signalling device may further comprise buttons to express "yes" or "no" in response to text or other data as displayed on the alarm signalling device.

The alarm signalling device may comprise multiple transceiver means to automatically transmit on a license exempt frequency to the responder device. If for whatever reason, a frequency is unavailable, an alternative transceiver means may contact the responder device at an alternative frequency.

The alarm signalling device may further comprise a camera, or other visualisation means for recording images, the images being adapted to be transmitted to the monitoring station via the responder device. This allows the end user at the monitoring station to assess the emergency situation and/or personal injuries and allows appropriate action to be taken and/or help to be provided.

An alarm system is formed by one or more alarm signalling devices and a responder device as hereinbefore described. The system is adapted to connect to the user's existing telephone line and is adapted to raise an alarm call by either pressing a panic button on the responder itself or by pressing the panic button on the alarm signalling device. In either case the user will be reassured that their call is being processed by both visual and audible indications. The system can be further configured to allow the user to answer incoming telephone calls by pressing either the panic button on the telephone console base unit or by pressing the button or separate button on the alarm signalling device.

Pressing the panic button on the responder device automatically dials the designated monitoring station or other preset numbers such as that of a friend or relative. The responder device also contains a powerful speaker (not shown) and a sensitive microphone (not shown) as a failsafe in case the microphone or speaker of the alarm signalling device do not function.

If the user's telephone is in use when an alarm is raised, the current call is cancelled, to ensure that the alarm call initiated by the alarm signalling device or via the panic button on the responder device has priority. The responder device also has the facility to detect if the end user has an answer machine or fax answering the alarm call or to detect if the line is engaged. In those cases, the responder device dials the next telephone number and so on, and then repeats the sequence until somebody answers the telephone from one of the programmed telephone numbers. Once the call has been made via the responder device, and the appropriate help given, the alarm signalling device is switched off or returned to sleep mode or back to its original state by a button on the alarm signalling device. Alternatively, the monitoring station can send a signal to the alarm signalling device via the responder device or directly to the alarm signalling device, to shut it down, or to return it to its original state.

Before the alarm signalling device shuts down or returns to its original state, relevant data from the alarm signalling device are sent to the monitoring station/end user which is followed by a signal to inform the monitoring station that the alarm signalling device is shutting down, or returning to its original state. Alternatively, the alarm signalling device may also be remotely reset by the user or end-user by dialling an appropriate telephone number and entering a code (which would be a code known only to those people concerned or involved with the system for security reasons) (not shown here). The alarm signalling device may also be reset by means of a key switch or code via the responder device or other integral unit which may be used to carry out the above function as well as for programming the system.

A waterproof alarm signalling device may be fitted to life jackets or clipped onto a person such that if the activator button is pressed, or the item is submerged in water, it automatically sends out a distress signal which is picked up via a wireless network. The location means in the form of a GPS may then help to locate the user. The user could communicate with the appropriate emergency services via the alarm signalling device by the means as herein before described.

There is thus provided an alarm system and an alarm signalling device, an alarm system and a method for receiving alarm signals as herein before described.

BRIEF DESCRIPTION OF THE DRAWINGS

The invention will now be described by way of example only and with reference to the accompanying illustrative drawings in which.

DETAILED DESCRIPTION

Figure 1:
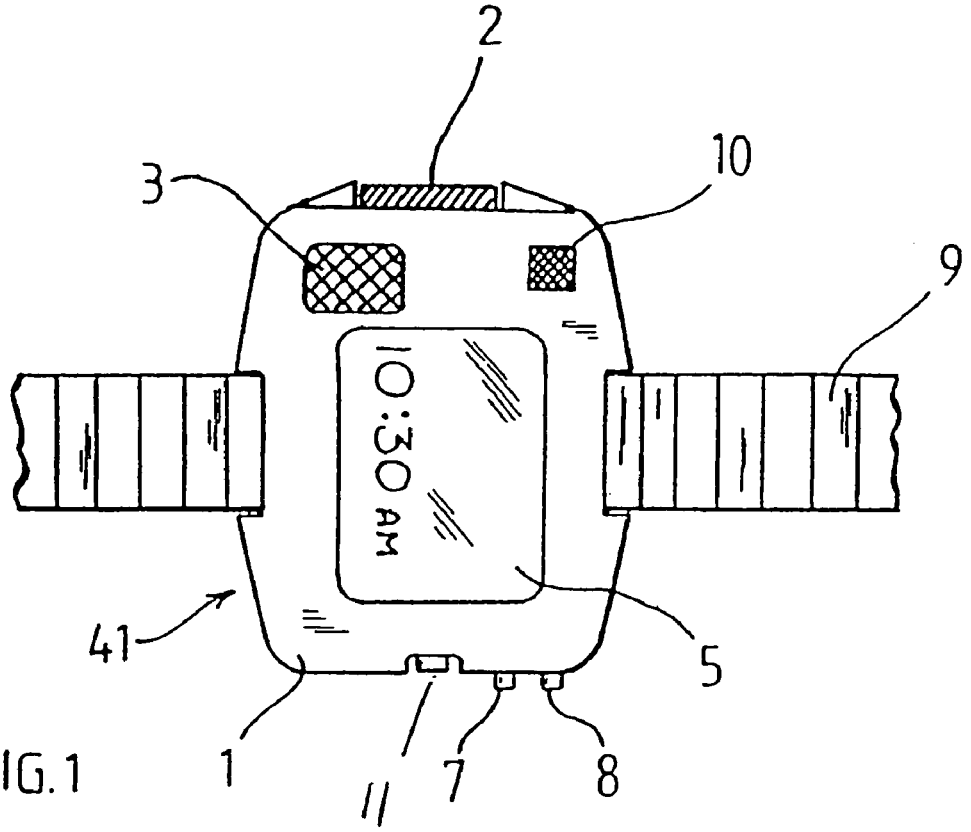
FIG. 1 is a diagrammatic view of an alarm signalling device according to an embodiment of the invention.
Figure 2:
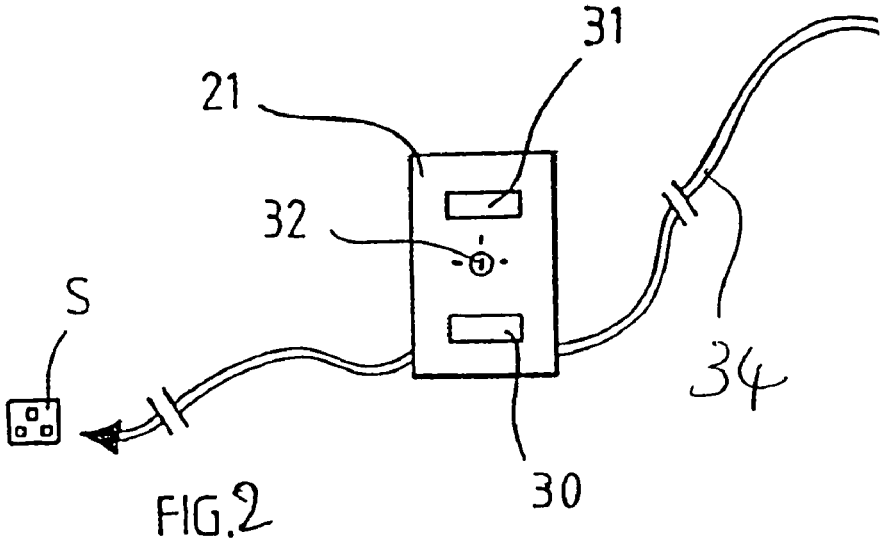
FIG. 2 is a diagrammatic view of a responder device according to another embodiment of the invention.

The alarm signalling device 41 is adapted to be worn on the user's body. The alarm signalling device 41 comprises a user activatable transceiver (not shown) for transmitting an alarm signal to a responder device 21. The transceiver is activated by the user by means of an emergency button 2. The transceiver is adapted to receive a response signal from the responder device 21 in response to the alarm signal. The alarm signalling device 41 further comprises a user display means in the form of an indicator light 10 to display the response signal to the user.

The signalling device 41 comprises interface means for receiving user data, said transceiver means being adapted to transmit the user data to the responder device after receipt of the response signal. The interface means further comprises means for receiving responder data, the transceiver means being adapted to receive the responder data from the responder device 21. The interface means comprises a sound receiving member in the form of a microphone 3 for receiving the user data and a sound producing member in the form of a speaker (not shown) for reproducing the responder data. In this way the user's voice is received and transmitted to the responder device 21 and the response from the monitoring station or aid services is provided to the user via the speaker on the alarm signalling device 41 to allow two way communication.

The alarm device 41 comprises a durable plastics housing 1 with a strap 9 which allows the device 41 to be worn on any part of the body. Preferably, the device is worn on the wrist like a watch. A display 5 is provided to display the time. Buttons 7 and 8 are provided to make adjustments to the setup and/or operation of the alarm signalling device 41.

The responder device 21 comprises a visual alarm 32 which is activated when an alarm signal is received from the alarm device 41. The device 21 further comprises a telephone dialling system for contacting emergency services and/or telephone services. A telephone connection 34 enables these services to be contacted via a land line. The user can hear the response from the services via the alarm signalling device 41. A display 31 shows the operation of the responder device 21. Button 30 allows the system to be reset and to return to its initial monitoring state when an alarm has been raised.

The responder device 21 may be mounted in a convenient location inside the building, powered either directly from the mains or via a socket S, with the back-up of rechargeable batteries in the event of mains power failure.

In use, the device 41 is worn on the body. If help is required by the user, the button 2 is pressed to activate the transceiver. Upon receipt of the alarm signal from the alarm signalling device 41, the responder device 21 transmits a response signal and the responder 21 conducts its help procedure. Upon receipt of the response signal, the alarm signalling device 41 activates the indicator light 11 to indicate that the responder device 21 has received the alarm signal.

The help procedure comprises the steps of the responder device 21 activating the attention light 32 and contacting outside help such as an emergency service. The user then communicates with the outside help via the microphone 3 on the device 41 whereby the user can hear the emergency services via the speaker in the alarm signalling device 41. After the user has been helped, the system is returned to its operational monitoring state by pressing the reset button 30.

The alarm system and alarm signalling device as hereinbefore described is suitable for both domestic applications and applications on a larger scale such as hospitals, care homes and nursing homes. In a particular advantageous embodiment, for large scale applications, the responder device comprises a wireless console which allows the end-user to be more mobile yet always be in immediate contact with the residents, if the panic button is activated.

What is claimed is:

1. A personal alarm system comprising:

a personal alarm signalling device adapted to be worn on a user's body comprising a user activatable transceiver for transmission of an alarm signal, the personal alarm signalling device including an activation button, and the personal alarm signalling device being activated only when the activation button is pressed to ensure that the personal alarm signalling device only begins to draw power once the personal alarm signalling device has been activated by the activation button; and a user activatable responder device adapted to contact outside help via a telephone network in response to the alarm signal, the responder device being provided locally in the vicinity of the user to thereby reduce power required for the alarm signalling device to contact the responder device, the responder device being adapted to receive the alarm signal and to transmit a response signal to the transceiver after receipt of the alarm signal to inform the user of the receipt of the alarm signal, the alarm signalling device comprising a user display for displaying the response signal to the user and an interface for receiving user data, the interface including a sound receiving member and a sound producing member to provide true two way instantaneous conversation via the alarm signalling device, the transceiver being adapted to transmit the user data to the responder device after receipt of the response signal and to receive responder data from the responder device, the interface being adapted to provide the responder data to the user.

2. An alarm system according to claim 1, wherein at least one of the user data and responder data include one of:

sound data, and audio data.

3. An alarm system according to claim 2, wherein the interface comprises the user display.

4. An alarm system according to claim 2, wherein the user display is adapted to display the responder data.

5. An alarm system according to claim 1, wherein the user data comprise at least one of:

the user's voice, and data relating to the user's physical condition.

6. An alarm system according to claim 1, wherein the transceiver comprises a signal channel selector for selecting a frequency or channel at which the transceiver transmits the alarm signal.

7. An alarm system according to claim 6, wherein the responder device comprises a responder channel selector for selecting the channel for receiving the alarm signal.

8. An alarm system according to claim 6, wherein the responder device is adapted to transmit a selection signal for controlling the signal channel selector, the transceiver being adapted to receive a selection signal from the responder device for controlling the signal channel selector.

9. An alarm system according to claim 8, wherein the responder device is adapted to control the signal channel selector in response to a reduced signal quality on the selected channel.

10. An alarm system according to claim 7, wherein the responder channel selector one of continuously and periodically transmits a channel monitoring signal for monitoring the quality of the transmissions channel or frequency.

11. An alarm system according to claim 1, wherein the user display comprises at least one of:

a visual display member, an audible display member, and a tactile display member.

12. An alarm system according to claim 1, further comprising a range monitoring device for monitoring a range between the alarm signalling device and the responder device.

13. An alarm system according to claim 12, wherein the range monitoring device is adapted to activate the user display if the signalling device is out of the range of the responder device.

14. An alarm system according to claim 13, wherein the range monitoring device is activatable by the user.

15. An alarm system according to claim 1, wherein the transceiver is adapted to transmit an identification code to identify the alarm signalling device from multiple alarm signalling devices.

16. An alarm system according to claim 1, wherein the alarm signalling device is adapted to remotely operate devices including doors and appliances.

17. An alarm system according to claim 1, wherein the responder device is adapted to contact outside help including aid services.

18. An alarm system according to claim 17, wherein the responder device comprises an alarm signalling device for signalling an alarm including at least one of a visual alarm and an audible alarm.

19. An alarm system according to claim 18, wherein the alarm signalling device of the responder device comprises a telephone dialling device for contacting outside help including at least one of emergency services and telephone services.

20. An alarm system according to claim 19, wherein the responder device is connected to a telephone network.

21. An alarm system according to claim 1, wherein the responder device comprises a telephone answering device for enabling the user to answer calls via the alarm signalling device.

22. An alarm system according to claim 15, wherein the system comprises at least one responder device and at least one alarm signalling device, the responder device signalling an alarm signal which corresponds to an identified signalling device.

23. An alarm system according to claim 22, further comprising an alarm procedure storage device for storing alarm procedures for each alarm signalling device, the alarm signalling device signalling an alarm in accordance with a stored alarm procedure for an identified alarm signalling device.

24. An alarm system according to claim 1, further comprising a locating device for locating the position of the alarm signalling device.

* * * * *